United States Patent [19]

Appelt

[11] Patent Number: 4,578,827

[45] Date of Patent: Apr. 1, 1986

[54] WAISTBAND ADJUSTER

[75] Inventor: Horst G. Appelt, Wuppertal, Fed. Rep. of Germany

[73] Assignee: Schaeffer Scovill Verbindungstechnik GmbH, Wuppertal, Fed. Rep. of Germany

[21] Appl. No.: 670,005

[22] Filed: Nov. 9, 1984

[30] Foreign Application Priority Data

Nov. 11, 1983 [DE] Fed. Rep. of Germany ..... 3340642

[51] Int. Cl.[4] ..... A41D 1/14; A41D 1/06

[52] U.S. Cl. ..... 2/221; 2/237

[58] Field of Search ..... 2/221, 237, 220

[56] References Cited

U.S. PATENT DOCUMENTS

| | | | |
|---|---|---|---|
| 2,626,397 | 1/1953 | Lewis | 2/237 |
| 3,703,729 | 11/1972 | Hinderer | 2/237 |
| 3,797,046 | 3/1974 | Hoch | 2/237 |

*Primary Examiner*—Doris L. Troutman
*Attorney, Agent, or Firm*—Dallett Hoopes

[57] ABSTRACT

A waistband adjusting element for garments such as trousers, which provides for greater flexibility in the adjustable connection of overlapping waistband sections, is disclosed. A detent rail is attached to the inner waistband member and has a movable slider mounted on it, coupled to a hinged locking tab provided with a central window, through which a cover strip passes to conceal the detent rail from view. The other end of the locking tab is pivotably coupled to the outer waistband section by flexible fabric loop which is capable of rotating from a flat position against the outer waistband section to a folded back overlapping position through an arc of approximately 180°. The flexibility of the fabric loop through its pivoting range allows the locking tab to also pivot through a corresponding 180° range between engaged and disengaged positions with respect to the detent rail.

The contour of the locking tab and an opposed pair of tapered or beveled corners facilitates the adjustment of the cover strip through the window of the locking tab as the waistband members are being moved relative to each other. The outer waistband member can also act as a gripping element to permit ready manipulation of the waistband sections relative to each other.

18 Claims, 7 Drawing Figures

WAISTBAND ADJUSTER

DESCRIPTION

The invention consists of a waistband adjuster, in particular for trousers, skirts, and the like, with a detent rail, attached to a waistband section, along which a slider can be moved which is connected to the other waistband section and which carries a hinged locking tab which extends beneath its hinge portion in the form of a cam and which is joined in a manner allowing for flexibility to the other waistband section by means of an intermediate loop at the window-shaped opening at the otherwise unattached end of the hinged locking tab.

A waistband adjuster of this type is known from German Laying Open Print No. 32 15 470. The intermediate loop in this instance consists of a hook sewed onto the inner waistband section. Flexibility is slight and is restricted to the existing play in the hook construction. Tension applied to the hinged locking tab by way of the hook provides additional locking security when the buckle flap is in the locked position. In order to adjust the waistband, the hook is disengaged, at which point the hinged locking tab is exposed and can be moved.

The purpose of the present invention is to construct a similar type of waistband adjuster which, in addition to being simplified in its production and more advantageous in its application, would allow the waistband to be adjusted easily without having to disengage the intermediate loop.

Such a construction represents a waistband adjuster of this type that has increased applicability. Access to the hinged locking tab no longer requires the disengagement of the intermediate loop. The latter is also the connector between the waistband section and the waistband adjuster. The necessity of having, for example, the pocket flap, where the waistband adjusters are generally attached, fold out, is avoided. Since the hinged locking tab no longer needs to be directly moved by hand, it can be very short. The lifting out movement corresponding to the usual tab length is no longer necessary. The adjustment can be carried out within the relatively narrow space between the waistband sections. This is achieved by allowing the loop corresponding flexibility and, in its coordinated functioning with the hinged locking tab, allowing it to extend over the entire pivot range of the hinged locking tab.

An advantageous aspect in its construction consists also of the loop being sewed onto the waistband section. A loop made of textile material, from that of a piece of clothing, for example, is especially flexible and can easily be included in the process of manufacturing clothing.

A further advantageous feature consists of the hinged locking tab with respect to the section between the outer frame cross-bar and its hinge having a contour that curves outward and with respect to the section of the hinged locking tab consisting of the frame cross-bar lying parallel to the detent rail in the locked position. This measure eases the coordinated functioning with the intermediate loop, since a larger accessible gap between it and the detent rail is thereby created. In addition, the curvature precisely in the area of the opening provides the advantage of allowing a strip covering the adjustment mechanism to be drawn through as described in the German Patent Print No. 22 52 950 assigned to the assignee of the present application. Correspondingly, an advantage is the otherwise unattached end of the waistband section being joined in a manner that allows for adjustability by means of a cover strip for the detent rail which is led through a loop and then through the opening in the hinged locking tab. Even if the intermediate loop is positioned further back, the outer waistband section is held snugly against the inner waistband section. The tapering in towards the inner flank of the opening aids in centering the intermediate loop and prevents misalignments of the waistband sections.

A more thorough elaboration of the object of the invention follows with the aid of illustrative drawings of design examples, in which.

Figure 1:
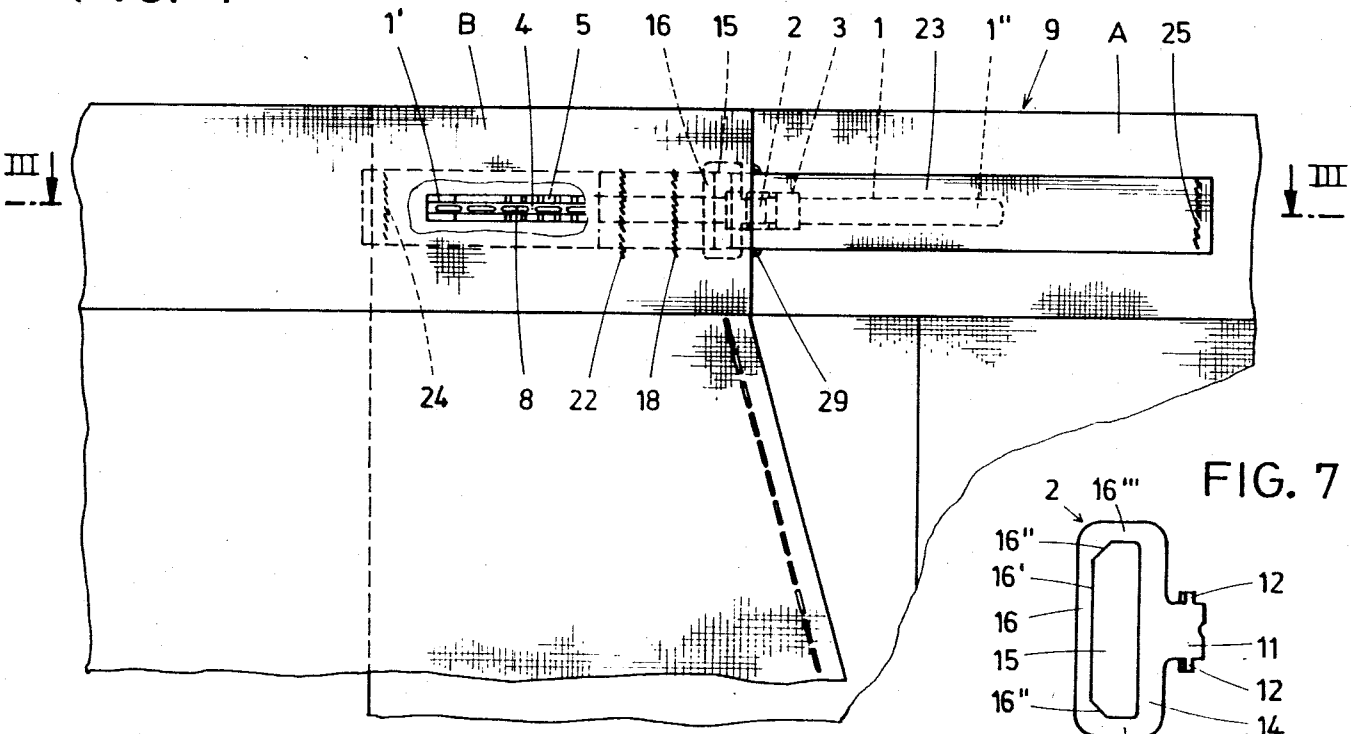
FIG. 1 shows a side view of the invented waistband adjuster on a pair of trousers, virtually true to scale.

The adjuster, which is moved along a detent rail 1 with narrowly spaced teeth, has hinged locking tab 2 as well as a movable slider 3.

The detent rail, which is sewed on along a groove 4 running along its length and dividing it in the middle, has notches 5 which run crosswise. The rail base 6 is indented (see FIG. 6). The C-shaped profile of the slider 3 encompasses the rail head 1. The C-shaped arms of the slider 3 extend down from its roof or bridge and are bent in twice such that the flange arms 7 extend around behind the outer edges of the detent rail 1. After the detent rail has been sewed on with a seam 8 along its center, the slider 3 is mounted. The detent rail retains the adjuster on the one section A of the waistband 9.

Figure 6:
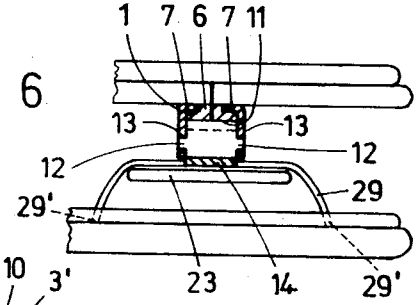
FIG. 6 shows a fragmentary sectional view corresponding to line VI—VI in FIG. 2.

The hinged locking tab 2 is positioned crosswise to the direction in which the slider 3 moves. The arms, bent at an angle to one another, are of different lengths. The shorter one 10 on the rail side forms a cam 11. The latter functions in connection with the detent rail notches 5. The cam 11 portion is cut in somewhat above the seam 8 in order to protect the seam 8. Further up on the cam 11 are two projections 12 that have been stamped out to form a hinge. The projections each protrude into holes 13 drilled into the socket support cut out of the C-shaped profile of the slider 3. In mounting the hinged locking tab, the socket supports are pressed slightly outwards. Once the projections 12 are in line with the socket holes 13, the socket supports can be pressed back inwards to a position in which both are parallel to one another as can be seen in FIG. 6. The hinged locking tab 2 is thereby permanently retained.

Figure 3:
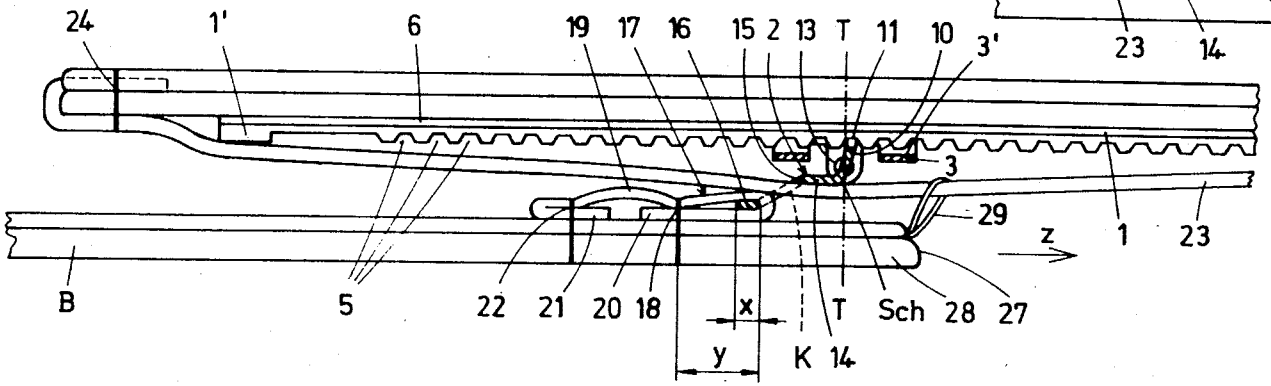
FIG. 3 shows a sectional view along line III—III in FIG. 1, illustrating the locked position.
Figure 4:
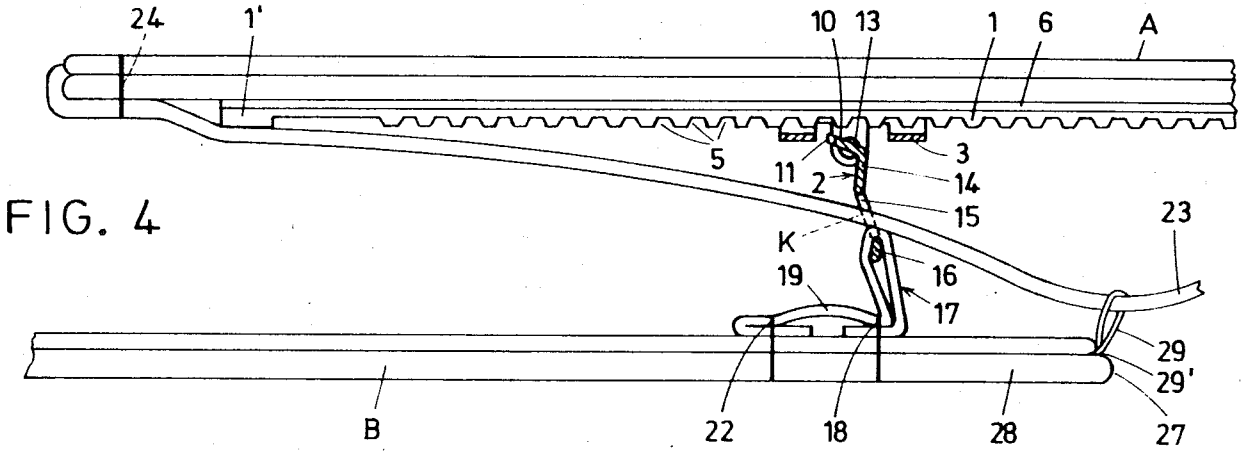
FIG. 4 shows the same sectional view of FIG. 3, but in a possible unlocked position.

The shorter arm 10 joins the longer arm 14 at the angle vertex Sch (FIG. 3), which lies just above the socket supports. When the slider 3 is in the locked position, this arm 14, which is worked directly, extends, with the exception of a partial curvature K, in basically the same direction as does the rail and the slider roof 3' running parallel to it.

The longer arm 14 of the slider assembly has a window-shaped opening 15. This opening begins midway along the length of the component and extends to the otherwise unattached end of the hinged locking tab 2. The remaining frame cross-bar 16 at the otherwise unattached end of the hinged locking tab serves as a flexible joint with the intermediate loop which takes the form of a loop 17 and which permanently retains the other waistband section B to the adjuster. The length y of the loop (FIG. 3) is substantially greater than the cross-sectional width × of the frame cross-bar 16. The loop 17 pivots towards the hinged locking tab at an angle of around 180° with the frame cross-bar 16 serving as an axis (see FIGS. 3 and ). The hinged locking tab itself has a pivot angle that is at least the same. The point at which the loop 17 is attached to the waistband is labeled 18. The joining mechanism, for example, can also be a metal ring held by a metal clamp.

Figure 7:
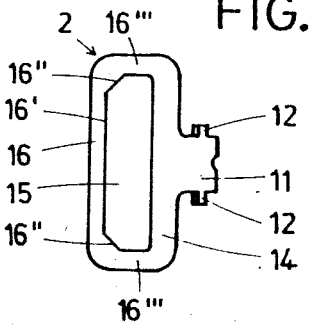
FIG. 7 shows a top view of another form of the hinged locking tab.
Figure 2:
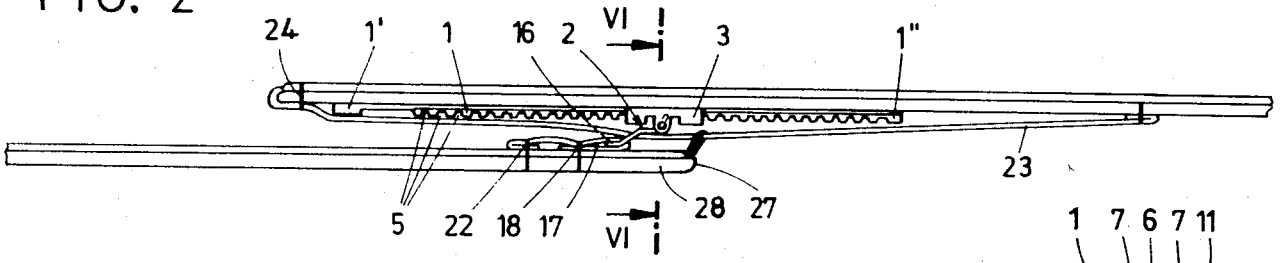
FIG. 2 shows a corresponding top view of the adjuster of FIG. 1.

The width of the loop corresponds to the width of the opening 15, or it is possibly narrower, in which case the loop is brought into proper position by means of the diagonal cuts 16'' in the inner flank 16' (see variation according to FIG. 7). The angle of the diagonal cuts is 45°. The diagonal sections 16'' extend about halfway into the length of the shorter frame cross-bar 16'''.

Instead of such a construction, the possibility exists, of course, that the loop 17 consist of a hidden loop 19 sewed on to the outer waistband section B. The point 18 at which it is attached, therefore, consists of a seam. The relatively short textile strip of which the loop consists is turned in at both ends, 20 and 21, the one end forming the fray-resistant seam. The other end 21 itself is also similarly attached; the point at which it is attached is labeled seam 22.

The curvature occurring along the longer arm 14 of the hinged locking tab 2 between the hinge 12 and the frame cross-bar 16 that forms the axis extends the point at which the loop is joined somewhat further out. The curvature section extends diagonally at an angle of 30° from the rail (the illustration shows the rail stretched out and not arched, as would be the natural result of wearing the garment). The corresponding diagonal cut positions the window-shaped opening at the point where the curvature K occurs more advantageously for receiving the cover strip 23 which is drawn through the hinged locking tab. The width of the strip corresponds to the windowshaped opening 15.

The strip is constructed such that it completely hides from direct view not only the detent rail 1, but also the greater portion of the hinged locking tab and the slider. The cover strip 23 is only sewed onto the waistband section A just beyond the ends 1' and 1'' of the detent rail. The seam is labeled in the first instance 24 and in the second instance 25 (see FIGS. 1 and 3–5).

Figure 5:
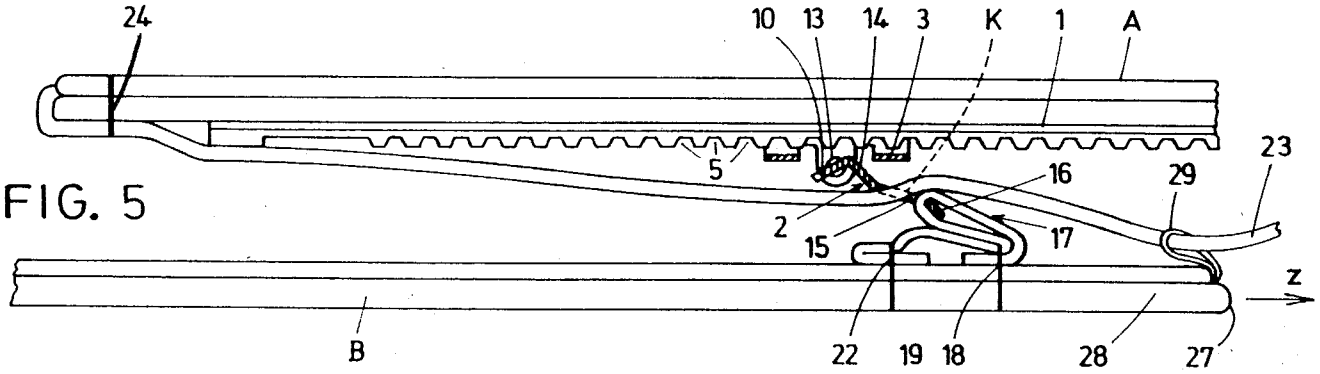
FIG. 5 shows the same sectional view when the slider is being moved, i.e., the waistband separation is being narrowed.

The point 18 at which the loop 17 is attached to the inner surface of the waistband section B is set back from the otherwise unattached end 27 of the waistband section B. The otherwise unattached section 28 pointed towards the right in FIG. 3 can, therefore, actually serve as a grip to work the mechanism. To open the adjuster, this section 28 need only to be grasped and pulled in the direction of the arrow z. In so doing, it is not even necessary to lift the waistband section A beyond the extension shown in FIG. 4. This intermediate phase in working the mechanism is here only supposed to make clear that, if needed, a rather large access space can also be made use of. Otherwise, however, the shape of the loop makes it possible to work the mechanism by pulling in the direction shown in FIG. 3 practically without extending it out to any noteworthy degree. Lifting waistband sectoins A and B away from one another in a parallel fashion allows for only a limited extension due to the short hinged locking tab; the loop slips into the opening 15 in a pivoting fashion. The opening is designed for this movement. Functioning that is similarly advantageous is also achieved if the loop 17 takes the form shown at 19; in passing through the linkage point, the latter practically rolls itself over (FIG. 5).

Once the slider 3—it is pulled along by the preceding loop which is tipped back—is moved, it suffices simply to release the outer waistband member B. The tension emanating from the waistband draws the hinged locking tab 2 into the new locked position by means of the flexible intermediate loop 17. The cam 11, which presses lightly against the detent rail along the center line T—T, retains the hinged locking tab in the newly set locked position. The functioning of the cam is supported by the pull-tension emanating from the intermediate loop. The otherwise unattached end 27 is guided in the process of adjustment by a U-shaped cord loop 29 that encompasses the cover strip 23. The ends 29' extend out frontally from a seam between the waistband section B and its inner lining. They are held by the hem seam.

What is claimed is:

1. An adjustable closure element for controlling the relative positions of waistband members of a garment, comprising a rail attached to a first of said waistband members, a slider mounted for sliding movement along said rail, a hinged locking tab pivotably connected to said slider and having a cam element at one end adapted to selectively engage with said rail at different positions of said slider relative to said rail, an intermediate loop mounted on a second of said waistband members for receiving the other end of said locking tab therein to allow relative pivotable movement therebetween, said locking tab having a pivoting range from a first position wherein said cam element is fully engaged with said rail to a second position wherein said cam element is disengaged from said rail, said intermediate loop being flexibly disposable from substantially contiguous to said second waistband member when said locking tab is in said first position to a self-overlapping configuration when said locking tab is in said second position.

2. An adjustable closure element in accordance with claim 1 wherein said intermediate loop has a fixed end attached to said second wiastband member and a free end defining a rotational arc around said fixed end, and the defined range of rotational movement of said loop from said substantially contiguous position to said self-overlapping configuration is substantially 180°.

3. An adjustable closure element in accordance with claim 2 wherein said intermediate loop between said fixed end and said free end comprises an endless ring, and said hinged locking tab includes a peripheral frame defining a central window, said frame having at least one cross-piece disposed wtihin said endless ring for establishing the arc of said pivoting range of said locking tab.

4. An adjustable closure element in accordance with claim 3 including a cover strip to obscure said rail and attached to said first waistband member and having a free end passing through said window of said locking tab, and wherein said second waistband member includes a holding loop thereon for retaining said free end of said cover strip proximate to said second waistband member after said free end passes through said window.

5. An adjustable closure element in accordance with claim 3 wherein said intermediate loop is constructed of a flexible material.

6. An adjustable closure element in accordance with claim 5 wherein said flexible material is fabric.

7. An adjustable closure element in accordance with claim 4 wherein said hinged locking tab further includes an arm coupling said cam element to said frame, and wherein said cross-piece is substantially parallel to said arm, each of said cross-piece and said arm being disposed in planes substantially parallel to said rail when said locking tab is in said first position.

8. An adjustable closure element in accordance with claim 7 wherein said window is defined between said cross-piece and said arm in an angular and non-orthogonal configuration to allow unobstructed selective adjustment of said cover strip through said window.

9. An adjustable closure element in accordance with claim 7 wherein said peripheral frame includes opposed bars connecting said cross-piece and said arm, and a corresponding pair of opposed beveled corners at the junctions of said cross-piece and said bars.

10. An adjustable closure element in accordance with claim 4 wherein said rail is provided with a plurality of spaced teeth to selectively accommodate said cam element therebetween, said teeth having a height sufficient to releasably engage said cam element in said first position thereof.

11. An adjustment assembly for waistband members comprising:

an elongate detent rail secured along one of the members, a slider engaging the detent rail and adapted to move therealong, the slider pivotally mounting a generally L-shaped lever intermediate its ends to provide a long leg extending away from the slider and a short leg adapted to engage between selected detents of the detent rail to lock the position of the slider on the rail, the distal end of the long leg being formed with a window and a terminal crossbar.

a flexible connecting first loop secured to the other of the waistband members and having a freely moveable bight, the first loop enclosing the crossbar, whereby relative lateral movement of the waistband members takes the lever through its full 180° range of motion between engagement and non-engagement of the short leg without the need for the members during the lateral movement to be spaced apart a distance greater than the length of the long arm and yet permitting them if so desired to be freely spaced apart a distance equal to the length of the long arm and the length of the first loop combined, all for the ease of manipulation by the wearer.

12. An adjustment assembly as claimed in claim 11 wherein the assembly additionally includes an elongate cover strip passing through the window and secured at opposite ends to the said one of the waistband members and concealing the detent rail from view.

13. An adjustment assembly as claimed in claim 11 wherein the first loop is secured to the said other waistband member by stitching and has a length substantially equal to the length of the long leg of the lever.

14. An adjustment assembly as claimed in claim 11 wherein the detent rail is stiffly flexible and comprises a row of evenly spaced outward detents and the rail is formed along its opposite sides with outward flanges engaged by opposite sides of the slider.

15. An adjustment assembly as claimed in claim 11 wherein the slider comprises a body having downward sides formed with aligned opposed recesses slidably engaging the flanges of the rail, the body also being formed with aligned outward pins receiving apertures and the L-shaped lever is formed adjacent the juncture of its legs with outward pins received into the ears to pivotally mount the lever of the slider.

16. An adjustment assembly as claimed in claim 11 wherein a second loop is attached to the free end of the said other member and receives the cover strip.

17. An adjustment assembly as claimed in claim 11 wherein the terminal crossbar is flat and is substantially parallel to the detent rail when the short leg engages between detents.

18. An adjustment assembly as claimed in claim 17 wherein the slider comprises a body having downward sides formed with aligned opposed recesses slidably engaging the flanges of the rail, the body also being formed with aligned outward pins receiving apertures and the L-shaped lever is formed adjacent the juncture of its legs with outward pins received into the ears to pivotally mount the lever on the slider.

* * * * *